United States Patent [19]

Reil

[11] Patent Number: 4,804,134

[45] Date of Patent: Feb. 14, 1989

[54] FLUID CONTAINER WITH HANDLE

[75] Inventor: Wilhelm Reil, Bensheim, Fed. Rep. of Germany

[73] Assignee: Tetra Pak Finance & Trading S.A., Pully, Fed. Rep. of Germany

[21] Appl. No.: 87,659

[22] Filed: Aug. 20, 1987

[30] Foreign Application Priority Data

Aug. 22, 1986 [DE] Fed. Rep. of Germany ..... 3628478

[51] Int. Cl.[4] ..... B65O 5/46

[52] U.S. Cl. ..... 229/52 A; 220/94 A; 229/125.11; 229/125.14

[58] Field of Search ..... 229/52 A, 52 B, 125.08, 229/125.09, 125.11, 125.14, 106; 220/94 R, 94 A; 222/556, 557, 465.1

[56] References Cited

U.S. PATENT DOCUMENTS

| | | | |
|---|---|---|---|
| 3,176,879 | 4/1965 | Mojonnier | 222/465.1 |
| 3,674,300 | 7/1972 | Simms | 222/465.1 |
| 3,924,797 | 12/1975 | Furbeck | 229/52 B |
| 4,526,314 | 7/1985 | Reil | 229/106 |
| 4,671,452 | 6/1987 | Pupp et al. | 229/52 B |
| 4,718,598 | 1/1988 | Pupp et al. | 229/52 A |

*Primary Examiner*—Stephen Marcus
*Assistant Examiner*—Gary E. Elkins
*Attorney, Agent, or Firm*—Howard M. Ellis; Michael L. Dunn

[57] ABSTRACT

Described is a fluid pack comprising a tube which is formed by a longitudinal sealing seam and at the ends of which are disposed a bottom (5) and a top (6) of which the top (6) comprises thermoplastic material without a carrier material, is injected on the tube (1) along the top edge thereof and has a pouring opening (7). The tube (1) comprises cardboard which is coated with plastic material on both sides. The bottom (5) is quadrangular and is formed from the folded-over tube (1) of the pack, in the form of a fold closure. A portion (3) of the tube wall which adjoins the top edge of the tube (1) is folded on to itself and joined to provide a double-wall base strip (4) which is triangular from the side. The cover (6) which is injected on to the tube is prolonged over the top edge (28) of the double-wall base strip (6) by a web portion (13).

To simplify the blank and enhance the quality of the pack, the invention proposes that the top (6) has two planes (6, 3) which are at an angle ($\alpha$), wherein the second plane (3) is partially made from cardboard and the handle (14) is joined to the top (6) and together therewith is injected on the double-wall base strip (4), within the parallelipipedic outside contour of the pack. The rearward edge (27) of the base strip is closed.

8 Claims, 3 Drawing Sheets

FLUID CONTAINER WITH HANDLE

Figure 1:
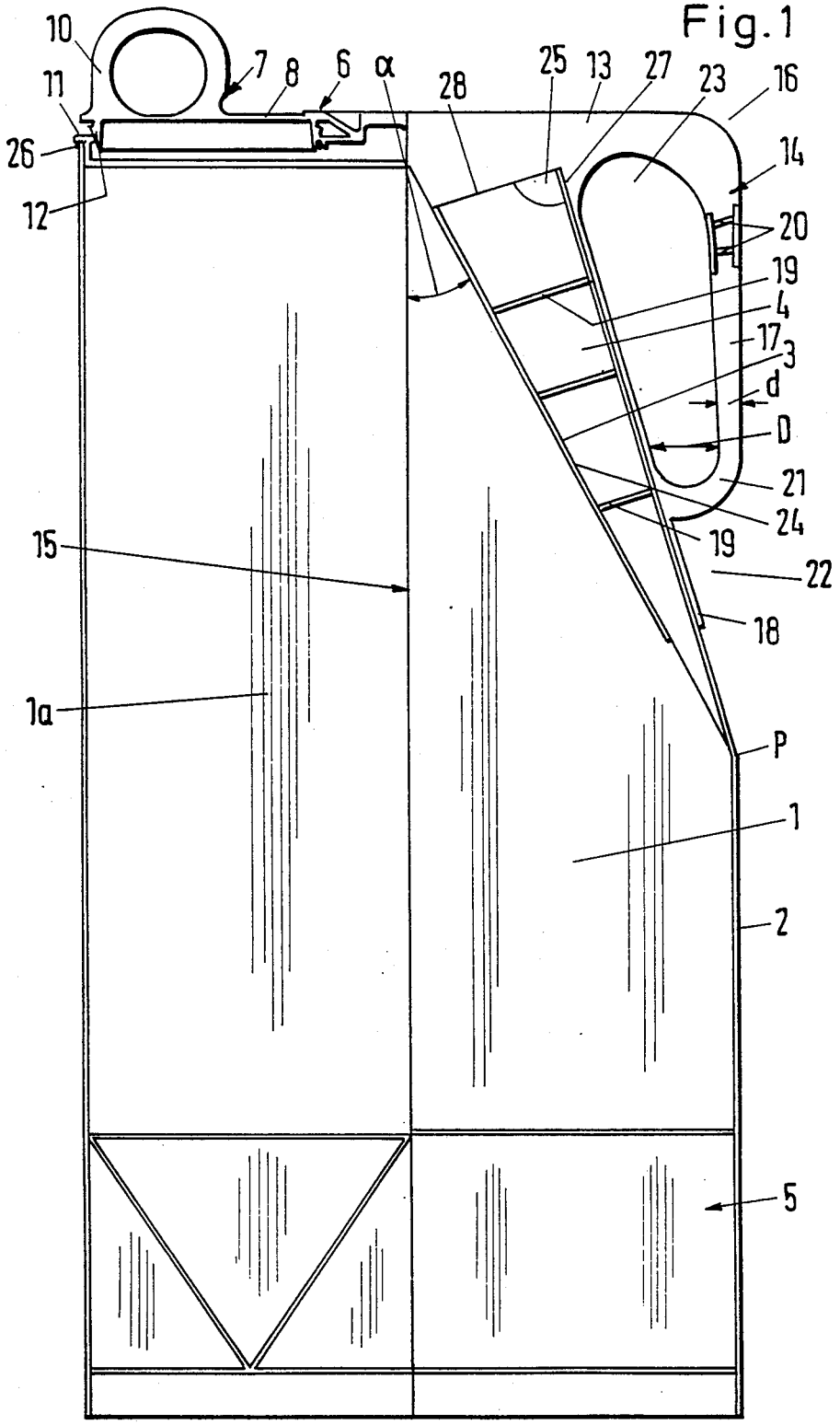

The invention relates to a pack for filling materials which are capable of flow, comprising a tube which is formed by at least one longitudinal sealing seam and at the ends of which are disposed a bottom and a top, of which the top comprises thermoplastic material without a carrier material, is injected on the tube along the top edge thereof and has a pouring means, wherein the tube comprises carrier material, for example cardboard, which is coated with thermoplastic material at least on one side, the bottom is quadrangular and is formed from the folded-over tube of the container pack, in the form of a folded closure, a portion of the tube wall, which adjoins the top edge of the tube, is folded on to itself and is joined to form a double-wall base strip which is triangular from the side, and wherein the top which is injected in position is extended above the top edge of the double-wall base strip by a web portion.

Various packs are known, for example fluid packs for milk, juices and the like, among which one design is for a pack volume of about two liters of fluid. That known pack has similar features to those set forth above. However the above-mentioned triangular double-wall base strip is itself provided with a gripping opening so that in other words the handle for that pack which is of heavy weight (containing two liters of fluid) is made from the material of the tube.

Besides various advantages in such a two-liter pack however it has been found that a not inconsiderable amount of distribution space in trucks, railway carriages or ships was uselessly wasted in transshipment and transportation operations. In the case of the first design of that two-liter pack, the aim, which was also achieved, was to provide an inexpensive option for manufacture thereof. However the tube used in that known pack was no longer of its cylindrical configuration in the handle area because material and space is required for the handle. As a result, as viewed from the side of the pack, a certain amount of volume was thrown away, in the upper region on the handle and in the lower part, beside one side of the bottom of the pack; although that volume did not play any part in regard to the pack itself, it did however play a part in regard to distribution surface area. It has been found in practice that the storage and stowage surface area on transshipment equipment, pallets, vehicles and the like is so expensive that the above-described space which is lost in regard to the filling material is not acceptable.

In the meantime consideration had also already been given to making the top of the pack quadrangular in plan view, or halving it, so that the flat top surface is of a triangular configuration in plan view, with a handle being provided in the half of the top which has been cut away. However that gave rise to problems in regard to sealing the pack and manufacture thereof so that the optimum solution has not yet been found.

Therefore, the object of the present invention is so to improve the pack of the kind set forth in greater detail in the opening part of this specification that, while simplifying the blank and the cutting operations on a web of material, it is possible to improve the sealed nature and the strength of the pack, while preferably also as much plastic material as possible is to be saved.

In accordance with the invention, that object is now achieved in that the top has at least three corners and at least a first and at least a second plane having a handle, which planes include an angle and of which the first plane of the top lies parallel to the plane of the bottom, the second plane is at least partially formed from the tube material, and the handle is connected to the top and together therewith is injected within the parallelipipedic outside contour of the pack on the double-wall base strip of which the rearward edge, which is towards the handle, is closed.

The idea of disposing a double-wall base strip on a second plane which is at an angle to the first plane was already the subject of design considerations. In that connection, the double-wall base strip was formed by cutting into a wall of the tube from the top edge in a V-shaped configuration, while, after the two wall portions of the base strip had been laid one upon the other, the base strip had an edge which was open rearwardly, towards the handle. Although tools had been developed to permit the two wall portions to be suitably aligned and secured together to form the base strip, that however involved a comparatively difficult folding operation, and the strength of the pack in the region of the handle was also not the best design.

In contrast, the invention provides that the rearward edge of the double-wall base strip, which is towards the handle, is closed. That increases the strength of the walls of the pack in the region of the base strip and the two layers of the double-wall base strip can also be better held together so that they always lie one upon the other precisely and in exact alignment, even with less expensive production machinery. Surprisingly, that means that the blank can be of a simple configuration. In the developed condition, it is in the form of a rectangle, and the disadvantageous V-shaped cuts from the top edge of the tube no longer have to be formed therein. If the pack is formed from a continuous web of material, simple blades are all that is required to cut one blank from the web, after another. In addition, it is also possible to use simpler folding tools, by virtue of the arrangement according to the invention. On the one hand, the double-wall base strip should preferably be connected to itself by heat sealing, while on the other hand the aim is that, in that operation, the top and if possible also the handle should be injection-moulded in position. In accordance with the invention that can be done by a single operation for, when the tools for injection moulding the top in position are closed, the operation of folding the double-wall base strip is automatically carried out and is performed simultaneously with the other machine functions.

The formation of a tube for such a pack is known for example in relation to a liquid pack. A tube is formed from the rectangular cardboard blank, which is in a flat condition, by means of embossed lines and a folding operation, by virtue of a longitudinal sealing seam being produced at one edge of the tube. In accordance with the invention that longitudinal sealing seam is preferably disposed at an edge which goes to one of the four corners of the top. Although in that connection it may be that edge which is arranged beneath the pouring opening or the pouring edge of the pack, it is particularly preferred to use one of the two edges of the tube which are disposed therebeside and which are therefore arranged between the front and rear sides of the pack. In accordance with the description, the front side of the pack is in this case the side having the pouring opening while the rear side is the side which has the handle.

Apart from the one longitudinal sealing edge described, the tube initially has no welded joins. It will be apparent to the man skilled in the art that that considerably and advantageously reduces the problems involved in sealing the pack, when dealing with liquids as the filling material. When the bottom is produced in the form of a folded closure and also when the top is injection-moulded on the top of the tube, it will be appreciated that further welding operations are carried out and welded seams produced, but taken overall the pack according to the invention has a minimum number of welded seams with a corresponding guarantee that the pack is properly sealed.

By virtue of the angular or corner-forming configuration of the top (in plan view), especially as the bottom is in any case polygonal in plan view, it is possible for the overall pack to be of an outside contour which is substantially better from the point of view of distribution than the above-described 2-liter pack in which the handle is completely produced from the tube material. With the parallelipipedic outside contour of the pack according to the invention, it is possible for one pack to be positioned very close to another, without any waste in respect of distribution volume. In that connection it is particularly advantageous for the handle to be disposed within the overall outside contour of the pack. Therefore even larger packs which, because of their weight, should advantageously have the handle, can be transported and stored substantially less expensively than hitherto.

In accordance with the invention it is also particularly advantageous if the handle has an upper horizontal web portion and a rearward vertical web portion which is in diametrally opposite relationship to the pouring edge, the web portions enclosing the gripping opening which is of a size for passing therethrough at least three fingers of the hand of an adult. Although attempts have already been made to inject handles of plastic material directly on to the pack, integrally with the top or cover thereof, those handles however were of an externally rounded contour. By virtue of the present invention, the handle now has inter alia an upper horizontal web portion which is disposed in the plane of the cover and which extends in such a position as to prolong the diametral line from the pouring means over the middle of the top of the pack to the oppositely disposed rearward edge. That provides a support line, thereby improving the stackability of a plurality of packs according to the invention one upon the other. The load-carrying capacity of the respective bottom pack is improved because the vertically directed forces due to the weights of the upper packs can now be transmitted into the edges, which have a very high load-carrying capacity, of the respective subjacent pack. In addition, in accordance with the invention care has been directed to making the gripping opening of a practical configuration because adults can easily handle a heavy pack, using three fingers of one hand. The gripping opening should not be of a smaller size. On the other hand a substantially larger gripping opening in turn requires more production material and gives rise to a dead volume, in regard to transportation of the pack.

A further advantageous embodiment of the invention provides that the double-wall base strip which is triangular in side view has a right angle, beside the handle, in side view, and its hypotenuse includes, with the longitudinal centre line of the tube, an angle which is of a magnitude of between 20° and 40°, preferably 25° and 30°. While the blank is rectangular so that the outside edges of the blank each form a right angle with each other, the top edge of the tube to which the top or cover of the pack has to be injection-moulded follows a kinked line after the operation of folding the tube, due to the configuration of the triangular base strip. That occurs due to the use of a portion of the wall material for the triangular base strip. If the latter is of such a configuration that the two triangular wall panel portions arranged to the right and to the left thereof are disposed in one plane, then that is the above-mentioned second plane which is at an angle to the first plane which is frequently referred to in the description herein as the 'horizontal plane', that is to say the plane in which the top or cover lies. It will be appreciated that that angle is 90° larger than the above-mentioned angle which the second plane in which the hypotenuse of the base strip also lies includes with the longitudinal centre line of the tube.

Practical tests have shown that the last-mentioned angle between the longitudinal centre line of the tube and the hypotenuse or second plane is of a size of 29° or 30°. In that case it is then possible to provide a sufficiently large gripping opening for the three fingers of a hand. In actual fact the size of the gripping opening is interrelated with that angle, while the cross-sectional dimension of the pack which is preferably a square also represents an important factor in regard to determining the value of that angle. The thickness of the handle also governs to a certain degree the angle which the manufacturer generally tries to make as large as possible but which is subjected to clear limitations, due to the above-mentioned factors.

It is also advantageous in accordance with the invention if at least the upper horizontal web portion of the handle is of a lateral width of 2–20 mm, preferably 6–12 mm, in the first plane of the top. As a result of that arrangement, the handle is strengthened against bending in a direction perpendicular to its main surface so that it projects out of the inclined so-called second plane substantially at an angle of 90°, and remains substantially rigidly in that position.

The strength aspect may be further enhanced in accordance with the invention if strengthening ribs are injected on both sides on the double-wall base strip. In that way it is possible to avoid injecting material entirely around the base strip, while nonetheless achieving the same advantages, from a static point of view. That therefore saves on plastic material, while however the strength aspect does not suffer.

In accordance with the invention it is also advantageous if both web portions of the handle are provided with strengthening ribs and that a free space without material is preferably disposed between the lower end of the vertical web portion and the point of intersection of the second plane with the edge of the tube. Those features serve on the one hand to save material and on the other hand to maintain or enhance strength, particularly in the region of the handle and its connection to the tube. The above-mentioned space ensures that a free space is left at points which do not have a support function or which could enhance the strength of the pack or the handle, without the appearance of the pack suffering as a result.

A highly advantageous embodiment of the invention provides that the pouring opening is provided with a pouring opening cover of oval configuration in plan view, and the annular flange which is formed on the pouring opening cover is arranged in the region of its outside edge and follows said oval shape. The oval configuration of the pouring opening, and therewith the pouring opening cover and therewith its annular flange which is formed thereon at the edge thereof improves the sealed nature of the pack when it is re-closed for the oval shape provides higher lateral stresses in the material which result in an improvement in the clamping forces and thus the sealing effect.

Figure 2:
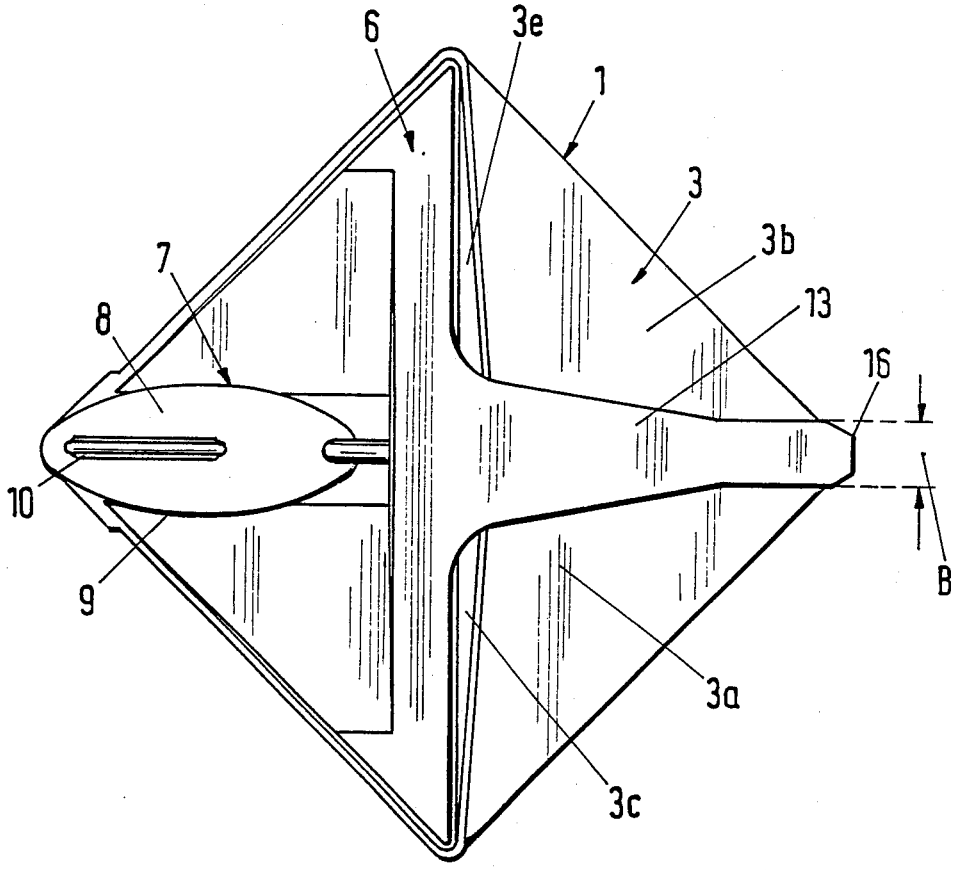
Figure 3:
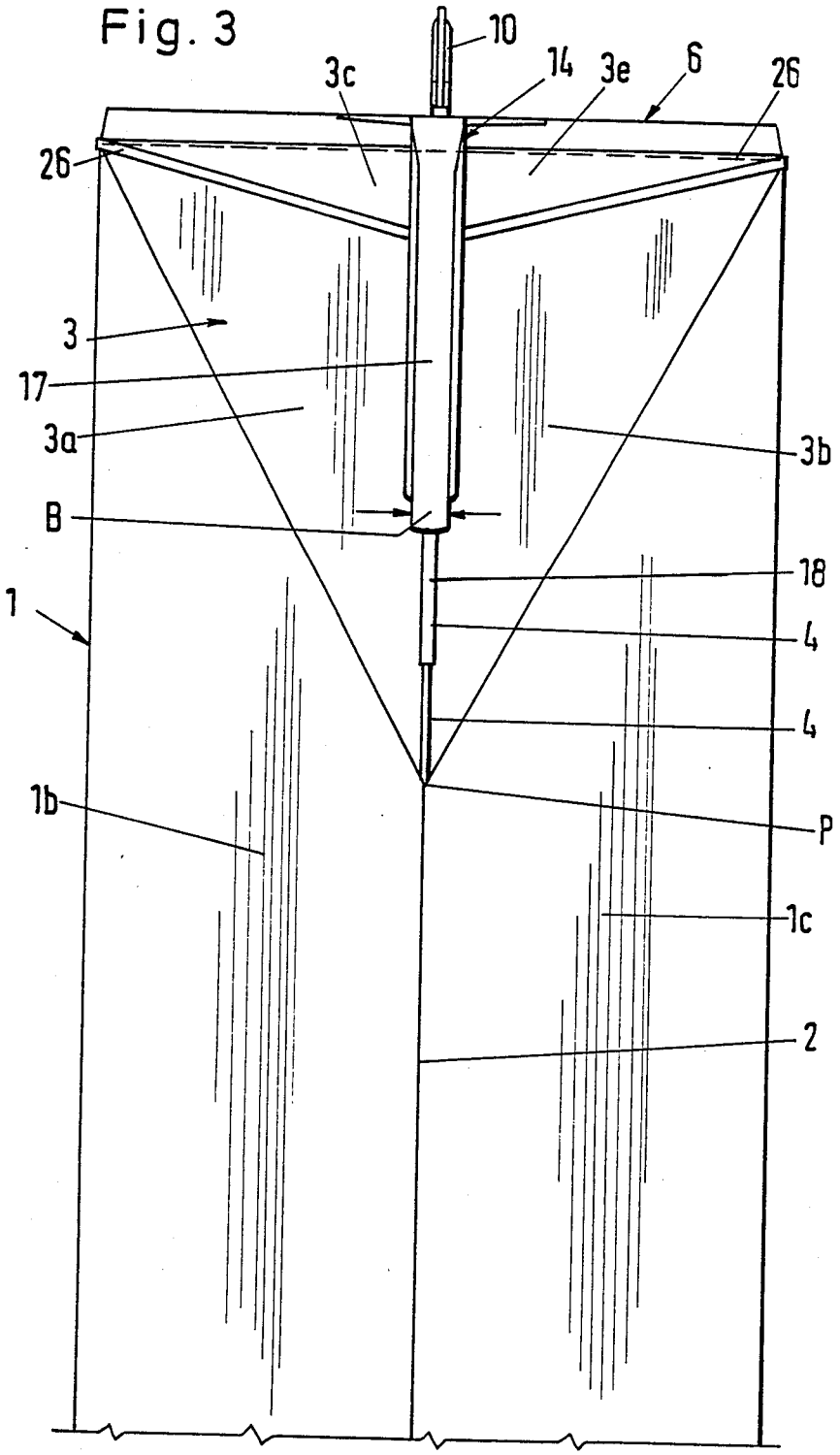

Further advantages, features and possible uses of the present invention will be apparent from the following description in connection with the drawings in which:

FIG. 1 shows a side view of the novel pack in which the bottom has not yet been finally folded, FIG. 2 shows a plan view of the pack shown in FIG. 1, and FIG. 3 shows a view, which is broken off at the bottom, from the rear of the pack, viewing from right to left in FIGS. 1 and 2.

The tube 1 of the illustrated pack forms the four side walls thereof, of which only the front two walls of which one can be seen in FIG. 1 and is identified by reference numeral 1*a* is rectangular. The other side walls which are denoted by 1*b* and 1*c* in FIG. 3 are of a trapezoidal shape. They are connected by way of the rear edge 2 which represents a fold edge. At the top they terminate at point P which represents the intersection of the so-called second plane 3 with the rear edge 2. More precisely, the second plane 3 is formed by the two triangular panels 3*a* and 3*b* which are connected together by way of the double-wall triangular base strip 4.

The bottom of the pack, which is generally denoted by reference numeral 5, is formed by the fold lines and wall panels which are shown at the bottom of FIG. 1. The top or cover of the pack is denoted by reference numeral 6.

The top 6 is of a triangular configuration, as can be clearly seen from FIG. 2. It forms the so-called first plane which is identical to the plane of the top 6 and which is horizontal, that is to say parallel to the surface of the bottom 5 when in its finished folded form (not shown).

The top 6 has the pouring opening 7 with pouring opening cover 8 which is of oval configuration in plan view (see FIG. 2), outside edge 9, opening strip 10, pouring edge 11 and annular flange 12. The partly sectional view in FIG. 1 shows that the annular flange 12 extends in the region of the outside edge 9 of the pouring opening cover 8 and thus follows the oval shape thereof.

The upper horizontal web portion 13 of the handle which is generally identified by reference numeral 14, for carrying the pack, extends in such a position as to prolong the first plane of the top 6.

The handle 14 is injected integrally on the top 6, comprises plastic material and is thus also directly joined to the two small triangular wall panels 3*c* and 3*e* which, together with the triangular wall panels 3*a* and 3*b*, form the so-called second plane which is generally identified by reference numeral 3. The view shown in FIG. 2 illustrates the length of the horizontal web portion 13 which extends from the centre of the pack where the longitudinal centre line 15 intersects the top 6, to the rearward corner 16. It is adjoined beneath same by the vertical web portion 17 which is injection-moulded on the double-wall base strip 4, by way of a plastic shaped portion 18.

The side view in FIG. 1 also shows the reinforcing ribs 19 which are injected on the double-wall base strip 4, on both sides, together with the handle 14, while FIG. 1 also indicates in broken-away form in the region of the vertical web portion 17 the strengthening ribs 20 which extend between the outside wall portions of the web portion. FIGS. 2 and 3 also show the width B of the web portions 13 and 17, which extends in the first plane of the top 6.

FIG. 1 shows the free space 22 beneath the lower end 21 of the handle 14, so that material is saved as a result. The gripping opening 23 is of such a configuration that three fingers of the hand of an adult can pass readily therethrough so that even when the pack is in the filled condition, with a capacity of up to 2½ liters, the pack can be properly handled.

Although the endeavour is for the point P (FIGS. 1 and 3) to be positioned as high as possible in order to increase the capacity of the pack, the size of the gripping opening 23, the lower thickness D of the opening 23 and even the height d of the vertical web portion (FIG. 1) limit the position of the point P and therewith also the size of the angle $\alpha$ between the hypotenuse 24 of the double-wall base strip 4 which is in opposite relationship to the right angle 25 and the longitudinal centre line 15 of the tube 1.

The top edge of the tube 1, which is identified by reference numeral 26 in FIGS. 1 and 3, is straight and extends horizontally in the region of the front two side faces (one front side face 1*a* can be seen in FIG. 1) while it extends over the two triangular wall panels 3*a* and 3*b* as a wide, upwardly open V-shape by way of which the two wall panels 3*c* and 3*e* which comprise plastic material are connected. That provides that the rear edge of the double-wall base strip 4, as identified by reference numeral 27, is closed. The top edge of the double-wall base strip 4 is denoted by reference numeral 28 (FIG. 1).

I claim:

1. A container, which comprises a container body having a top edge at a first end of said body, a container bottom at a second end of said body opposite the first end providing a quadrangular shape to said container body in the region of said second end, a triangular shaped container top having a substantially planar and substantially horizontal surface with outlet means at the first end of said body engaged with said top edge of said body providing a triangular shape to said body at said first end and a taper of a side of the container body beginning from said triangular shaped container top extending outwardly to the quadrangular shaped region of said second end, and a base strip and container handle means affixed to said base strip on the tapered side of the container body for reinforcing the container body in the region of said base strip.

2. A container, which comprises a container body having a top edge at a first end of said body, a bottom closure at a second end of said body opposite the first end providing a quadrangular shape to said container body in the region of said second end, a triangular shaped container top with outlet means at the first end of said container body engaged with said top edge of said body providing a triangular shape to said body at said first end and a taper of a side of said container body beginning from said triangular shaped container top and expanding outwardly to said quadrangular shaped region of said second end, a base strip comprised of a double wall, and closed container handle means affixed to said base strip on the tapered side of said container body, said handle means comprised of an upper horizontal web portion extending from a plane of the container top which is parallel with the bottom closure and a vertical web portion extending from said upper horizontal web portion in a plane which is parallel with the longitudinal axis of said container body.

3. The container of claim 2 wherein the double wall base strip is a closed member and the container handle is connected to said triangular shaped container top.

4. The container of claim 3 wherein the dimensions of the handle do not exceed the outer contour of the quadrangular shaped container body.

5. The container of claim 3 wherein the container top and handle are unitized and injection molded to the top edge of the container body.

6. The container of claim 5 wherein the horizontal web portion of the handle and container opening of the unitized top are aligned diametrically opposite to one another.

7. The container of claim 6 wherein the handle includes means for reinforcing the connection of said handle to said double-wall base strip.

8. The container of claim 7 wherein the reinforcing means comprises rib members extending from the handle to each side of the double-wall base strip.

* * * * *